United States Patent [19]

Cantley

[11] 4,222,042

[45] Sep. 9, 1980

[54] DOOR ALARM

[76] Inventor: Richard E. Cantley, 1469 Shelley St., NE., North Canton, Ohio 44720

[21] Appl. No.: 47,576

[22] Filed: Jun. 11, 1979

[51] Int. Cl.[2] ..... G08B 13/08

[52] U.S. Cl. ..... 340/546; 200/61.78; 200/61.93; 340/545

[58] Field of Search ..... 340/545, 546; 200/61.93, 61.78, 61.81, 61.62

[56] References Cited

U.S. PATENT DOCUMENTS

| | | | |
|---|---|---|---|
| 567,176 | 9/1896 | Unger | 200/61.78 |
| 1,099,777 | 6/1914 | Sundel . | |
| 1,110,893 | 9/1914 | Caulkins . | |
| 1,377,939 | 5/1921 | Sundel . | |
| 2,492,474 | 12/1949 | Gempp | 200/61.78 |
| 2,824,300 | 2/1958 | Rand . | |
| 3,121,864 | 2/1964 | Bowman | 340/546 |
| 3,261,010 | 7/1966 | Kardel . | |
| 3,270,333 | 8/1966 | La Barber . | |
| 3,378,830 | 4/1968 | Patrick . | |
| 3,768,086 | 10/1973 | Powell et al. . | |
| 3,798,627 | 3/1974 | Kaufman . | |
| 3,878,539 | 4/1975 | Gooding . | |
| 4,059,832 | 11/1977 | Conklin . | |
| 4,123,752 | 10/1978 | Novotny . | |
| 4,124,847 | 11/1978 | Cashman | 340/545 |

*Primary Examiner*—Glen R. Swann, III
*Attorney, Agent, or Firm*—Frease & Bishop

[57] ABSTRACT

An improved door alarm which is mounted on the inside of a door adjacent the hinged edge thereof sounds an audible alarm when the door is opened. A housing containing a buzzer and a battery is mounted on the door by a pressure-sensitive adhesive. An arming lever is pivotally mounted on the housing and together with a conductor extends outwardly therefrom and operatively engages an actuator block which is mounted on the door frame adjacent the alarm housing. The lever and conductor are operatively connected with the battery and buzzer to form an alarm circuit which will actuate the buzzer when brought into contact with each other at the actuator block. The actuator block has an insulated shelf with which a hooked end of the arming lever is engaged when the alarm is armed and an alarm actuating zone wherein the lever end disengages the shelf and engages an end of the conductor located therein to complete the alarm circuit and actuate the buzzer. The shelf has an undercut into which the hooked end of the lever moves if the door is closed after the buzzer has been actuated to maintain contact between the lever end and conductor to keep the buzzer sounding. The actuator block has an adjustable top wall on which the lever end can be placed when the occupant leaves the protected dwelling so that when the door closes, the lever end engages the shelf to arm the alarm for actuation when the door is next opened.

17 Claims, 13 Drawing Figures

DOOR ALARM

BACKGROUND OF THE INVENTION

1. Field of the Invention

The invention relates to protective devices for doorways and in particular, to an alarm which is mounted on the door adjacent the hinged edge, and which is actuated when the door is opened to sound an audible alarm. More particularly, the invention relates to a door alarm having a mechanical mechanism for actuating the alarm upon opening of the door and for maintaining the alarm actuated even if the intruder closes the door, and in which the alarm can be automatically armed by the user upon leaving the doorway.

2. Description of the Prior Art

Numerous devices have been devised and constructed over the years for mounting on a door or adjacent thereto for sounding an alarm when the door is opened to protect the occupants of the dwelling. Usually, these alarms are designed to be armed at night from within the protected dwelling and disarmed during the daytime when the door is continually being used. Examples of such prior art alarms are shown in U.S. Pat. Nos. 1,099,777, 1,377,939, 2,824,300, 3,121,864, 3,261,010, 3,270,333, 3,378,830, 3,768,086, 3,798,627, 3,878,539 and 4,059,832.

Many of these prior devices appear to provide a satisfactory alarm and are suitable for their intended purposes. However, nearly all of these known prior alarm devices, with the exception of the alarm shown in U.S. Pat. No. 3,121,864, are mounted closely adjacent the swinging end of the protected door or on the top thereof. This location enables the alarm to be deenergized quickly by an intruder when reaching only his hand and arm through a partially opened door. Also, some of the mounting brackets of these prior devices can be seen from the outside of the door revealing their presence to an intruder, and facilitating the disarming of them.

It also is desirable that such alarms remain activated even if the door is fully opened or immediately closed by an intruder. Many of the known prior alarm devices will deactivate immediately upon closing the door. U.S. Pat. No. 1,110,893 discloses a door knob mounted alarm which will remain activated until manually reset. However, many doors have door knobs or handles that prevent the mounting of such an alarm device thereon.

Another desirable feature not found in most prior alarm devices is means for arming the alarm by the user upon leaving the protected dwelling. U.S. Pat. No. 4,123,752 discloses the only alarm of which I am aware that permits the arming of an alarm upon the user leaving the doorway.

Also, it is desirable that these alarms are portable for use by an individual during travel, enabling the alarm to be mounted on the doorway of motels, hotels, etc., without requiring the use of attachment means such as screws or bolts which will mar the door or frame surface, as do most of the above-listed prior art alarms.

Although many of these prior art devices are believed to perform satisfactorily, I believe that my device provides an extremely simple, rugged and inexpensive alarm which provides the advantages of maintaining the alarm actuated even if the intruder immediately closes the door, provides an alarm which can be either permanently or temporarily installed on a doorway without marring the finish thereof, and provides an alarm which can be armed by the user upon leaving a protected dwelling by simple mechanical means.

SUMMARY OF THE INVENTION

Objectives of the invention include providing an improved door alarm which is formed of an inexpensive plastic housing containing an audible signaling device operated by a standard 6-volt or 9-volt battery located within the housing, and in which the associated alarm-activating components are formed of a usual coil spring and an arming lever formed of a strip of spring steel; providing such an alarm which is adapted to be mounted adjacent the hinged edge of a door to make it less accessible by an intruder than if mounted adjacent the swinging edge of the door, and in which such mounting is less noticeable to visitors and occupants of the protected dwelling; providing such an alarm which will remain actuated even if the door is immediately closed by an intruder or opened all the way, until the alarm is manually deactuated; providing such an alarm which can be automatically armed by a user upon leaving the protected doorway by simple mechanical means; providing such an alarm which is mounted on the door and adjacent frame by pressure-sensitive adhesive for a permanent installation or for easy removal therefrom for use as a temporary installation on motel or hotel doorways or the like, without marring the finish of the door or frame; providing such an alarm which can be repaired easily should it become damaged without requiring special replacement parts in that the components thereof are easily and readily obtainable or can be fabricated easily; and providing such an improved door alarm which is of an inexpensive, rugged, durable construction, which eliminates difficulties existing in the art and which solves problems, satisfies needs and obtains new results in the art.

These objectives and advantages are obtained by the improved door alarm construction of the invention, the general nature of which may be stated as including a housing adapted to be mounted on a door adjacent the hinged edge of said door; audible alarm means contained within the housing; an actuator block adapted to be mounted on the door fame adjacent the alarm means housing; conductor means operatively connected to the alarm means and extending between the alarm means and actuator block; lever means mounted on the housing and connected to the alarm means and cooperatively engageable with the actuator block and the conductor means, with said lever means being movable upon opening of the door to contact the conductor means at the actuator block and actuate the alarm means; and means provided on the actuator block to maintain contact between the lever means and conductor means once the alarm means is actuated to keep the alarm means actuated upon closing movement of the door.

BRIEF DESCRIPTION OF THE DRAWINGS

A preferred embodiment of the invention—illustrative of the best mode in which applicant has contemplated applying the principle—is set forth in the following description and distinctly pointed out and set forth in the appended claims.

Similar numerals refer to similar parts throughout the drawings.

DESCRIPTION OF THE PREFERRED EMBODIMENT

Figure 1:
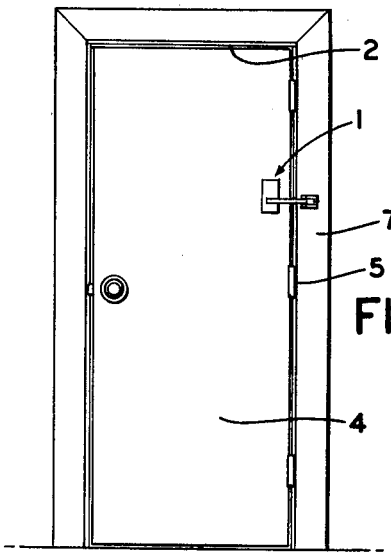
FIG. 1 is a diagrammatic view of a doorway with the improved door alarm mounted on the door and frame thereof.

The improved door alarm construction is indicated generally at 1, and is shown in FIG. 1 providing protection for a doorway 2. Door alarm 1 includes two main components, a housing-alarm assembly 3 which is mounted on a door 4 adjacent the hinged edge 5 thereof, and an actuator block 6 which is mounted on the door frame 7 horizontally adjacent housing-alarm assembly 3.

Figure 2:
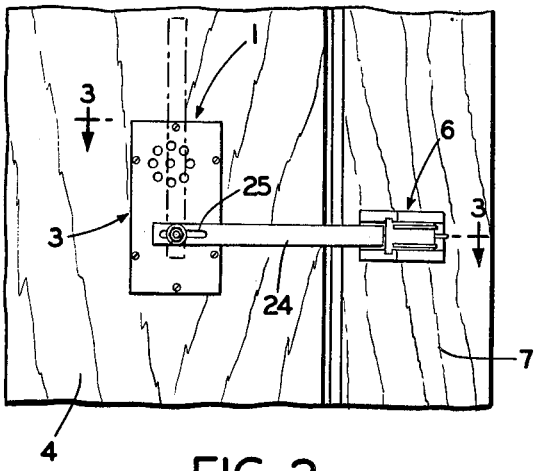
FIG. 2 is an enlarged view of the improved door alarm of FIG. 1 with the arming lever being shown in the armed position in full line and in the disarmed position in dot-dash lines.
Figure 6:
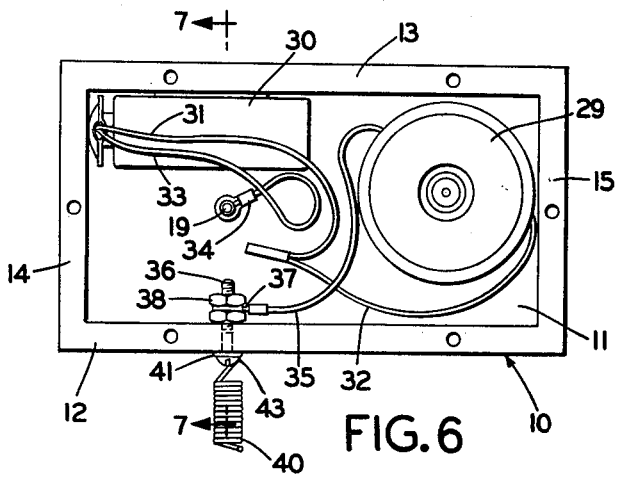
FIG. 6 is a top plan view of the alarm components mounted within a housing with the top cover being removed therefrom.
Figure 7:
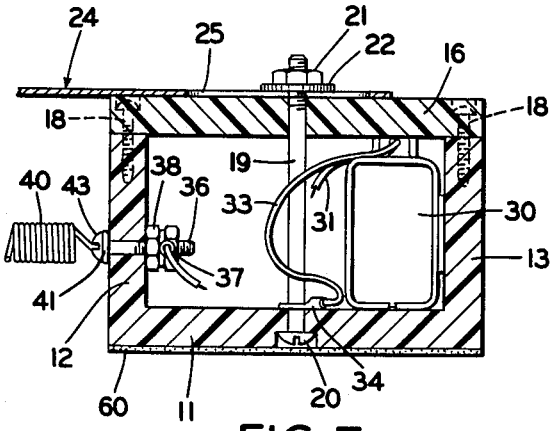
FIG. 7 is an enlarged sectional view taken on line 7—7, FIG. 6, with the housing cover being shown mounted thereon and in section.
Figure 8:
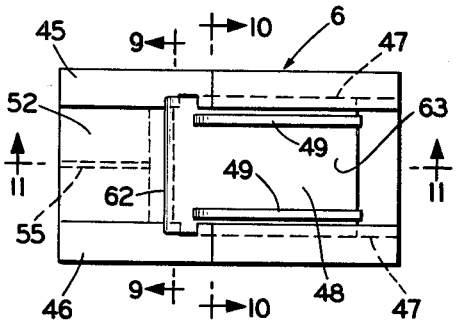
FIG. 8 is a top plan view of the actuator block removed from the door frame.

The housing-alarm assembly 3 is shown particularly in FIGS. 2, 6 and 7, and includes a housing 10 having a bottom wall 11, a pair of parallel spaced side walls 12 and 13, and end walls 14 and 15. Walls 11-15 preferably are formed integrally of a molded plastic material. A cover plate or top wall 16, also formed of the same plastic material, is removably mounted on the top of the housing by a plurality of screws 18 and a bolt 19 (FIG. 7). The head 20 of bolt 19 is countersunk in bottom wall 11 and extends vertically upwardly through a hole in cover plate 16 having a clamping nut and washer 21 and 22 mounted on the top threaded end thereof.

An arming lever 24 is pivotally mounted on housing cover plate 16 by bolt 19. Bolt 19 extends through an elongated slot 25 formed in the end of lever 24, with nut 21 and washer 22 clamping the lever against cover plate 16. Lever 24 is clamped sufficiently loosely against top wall 16 to enable it to be rotated from the disarmed position (shown in dot-dash lines, FIG. 2) to the armed position (full lines) and yet sufficiently tight to maintain the lever in either position without any additional supporting means. Lever 24 is formed of spring steel to provide flexibility thereto as well as a biasing action as described below. Also, the steel enables the lever to conduct electricity and to form part of the alarm circuit. The extended end of lever 24 is formed with a reversely bent hook-shaped end 26.

The alarm circuit consists of a usual audible sound-producing buzzer 29 operated by a standard 6-volt or 9-volt battery 30. Battery lead 31 is connected to buzzer lead 32 with the other battery lead 33 being connected to bolt 19 by a clip 34. The other buzzer lead 35 is connected to a terminal post 36 by a clip 37. Post 36 is a bolt that extends through side wall 12 having a pair of clamping nuts 38 mounted on the inner threaded end thereof for clamping lead clip 37 thereon.

A metal coil spring 40 has a hook end 41 which is clamped by head 43 of post bolt 36 against side wall 12. The other end of spring 40 terminates in a straight section of wire 42 which engages actuator block 6.

Figure 11:
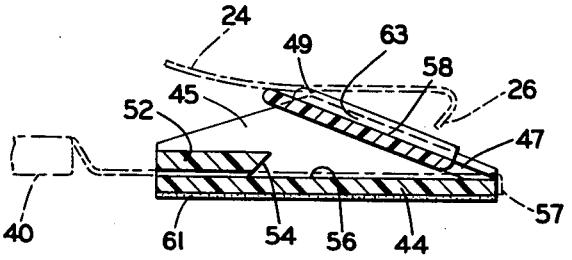
FIG. 11 is a sectional view taken on line 11—11, FIG. 8, with the arming lever shown in dot-dash lines being placed on the top wall of the actuator block for arming the alarm system automatically upon closing the protected door when leaving the protected structure.
Figure 12:
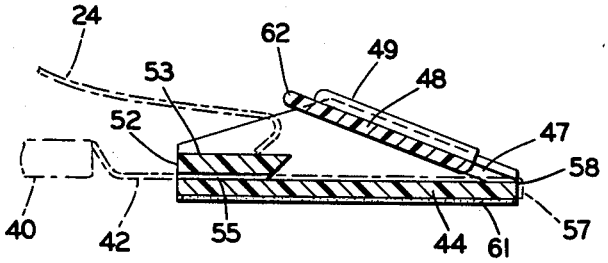
FIG. 12 is a view similar to FIG. 11 showing the position that the arming lever assumes after the door has been closed from that of FIG. 11, or the position it assumes when manually set by a user as in FIG. 3 to arm the alarm system.
Figure 10:
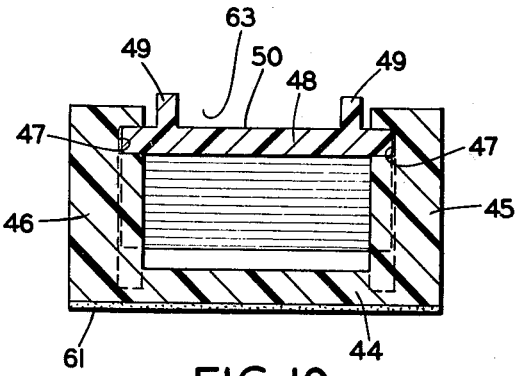
FIG. 10 is an enlarged sectional view taken on line 10—10, FIG. 8.
Figure 13:
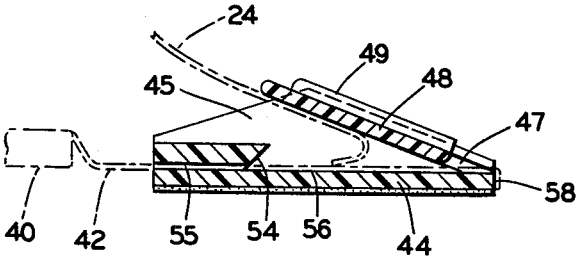
FIG. 13 is a sectional view similar to FIGS. 11 and 12 showing the position of the arming lever upon the protected door being moved to a nearly full open position.

Actuator block 6 is shown primarily in FIGS. 8-13 and consists of bottom wall 44 and a pair of spaced side walls 45 and 46 formed integrally therewith. Side walls 45-46 have a generally triangular-shaped configuration, as shown in FIGS. 11-13 with a pair of grooves 47 being formed in the rearwardly downwardly sloping portions thereof adjacent the top edges for slidably receiving a top wall 48 therein. Top wall 48 has a pair of spaced upstanding ribs 49 which extend along the top surface 50 and from a guide channel 63 therebetween.

Figure 9:
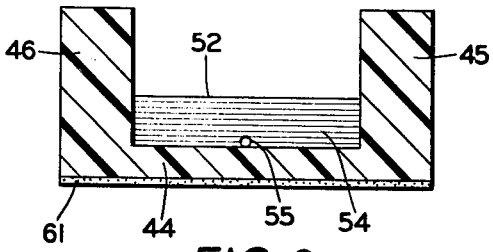
FIG. 9 is an enlarged sectional view taken on line 9—9, FIG. 8.

A shelf 52 is formed integrally with and extends upwardly from the front portion of bottom wall 44. Shelf 52 has a flat top surface 53 and a reversely, downwardly angled inner edge 54 which forms an undercut configuration between shelf 52 and top surface 56 of bottom wall 44. A hole 55 extends longitudinally through shelf 52 and coincides with inside surface 56 of bottom wall 44 (FIG. 9). Straight end 42 of spring 40 extends through hole 55 and along the center of surface 56 and terminates in a bent tip 57 which extends downwardly along the rear edge 58 of bottom wall 44.

Figure 3:
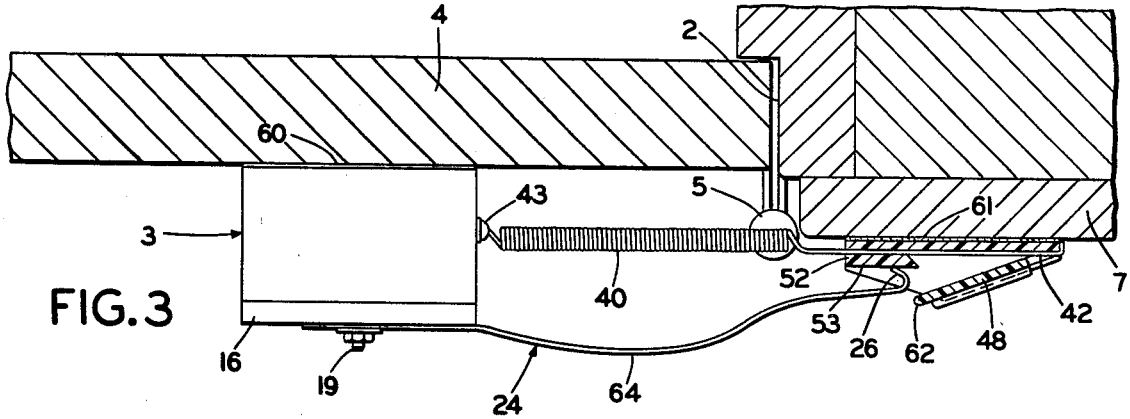
FIG. 3 is an enlarged fragmentary sectional view taken on line 3—3, FIG. 2, with the arming lever being shown in armed, deactuated position.

Actuator block 6 preferably is formed of a plastic material or other electrical insulating type material which electrically isolates lever end 26 from spring end 42 when in the armed but deactuated position of FIGS. 3 and 12.

The operation of improved door alarm 1 is described below and is shown in FIGS. 2-5 and 11-13. Housing-alarm assembly 3 is mounted on door 4 closely adjacent the hinged edge 5 by a layer of pressure-sensitive adhesive 60 which covers the bottom surface of housing wall 11. Actuator block 6 is mounted on door frame 7 also by a layer of pressure-sensitive adhesive 61 covering the bottom surface of bottom wall 44 horizontally adjacent housing 11 (FIG. 2). To arm door alarm 1 from the inside of a protected doorway, the user manually pivots lever 24 to the horizontal position of FIG. 2, wherein hook end 26 engages top surface 53 of shelf 52, as shown in FIGS. 3 and 12. Lever 24 is bent whereby an inwardly biasing force is exerted on end 26 pressing it against shelf 52.

Figure 4:
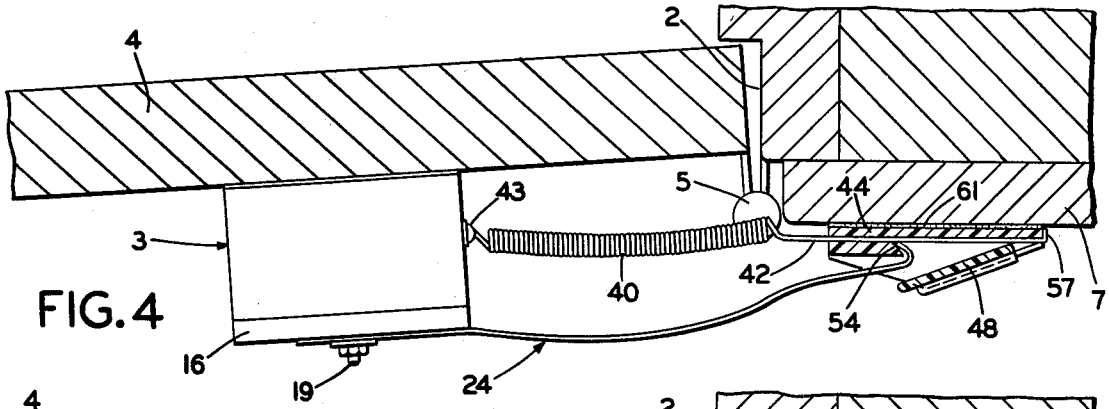
FIG. 4 is a view similar to FIG. 3 with the door being shown in partially open position and the arming lever in alarm-actuating position.

Opening of door 4 only a very slight amount from the position of FIG. 3 to that of FIG. 4 will cause hook end 26 to move rearwardly along shelf surface 53. Upon hook end 26 reaching shelf edge 54, it will drop inwardly and contact end 42 of spring 40 which extends along inside surface 56 of actuator block 6. This contact completes the electrical circuit between battery 30 and buzzer 29, immediately energizing buzzer 29 to sound an audible alarm. Continued opening movement of door 4 merely results in the bending or flexing of spring 40 with no ill effects thereto. Lever end 26 will continue to slide along inside surface 56 of actuator block 6 and maintain contact with spring end 42 until reaching the position of FIG. 13. Lever 24 will bend about the front edge 62 of top wall 48 if the door is completely open. This bending will not impart any set or crease to lever 24 due to its spring-back characteristics in that it is formed of spring steel, enabling it to return to its normal prebent adjusted position, as shown in FIGS. 3–5.

Figure 5:
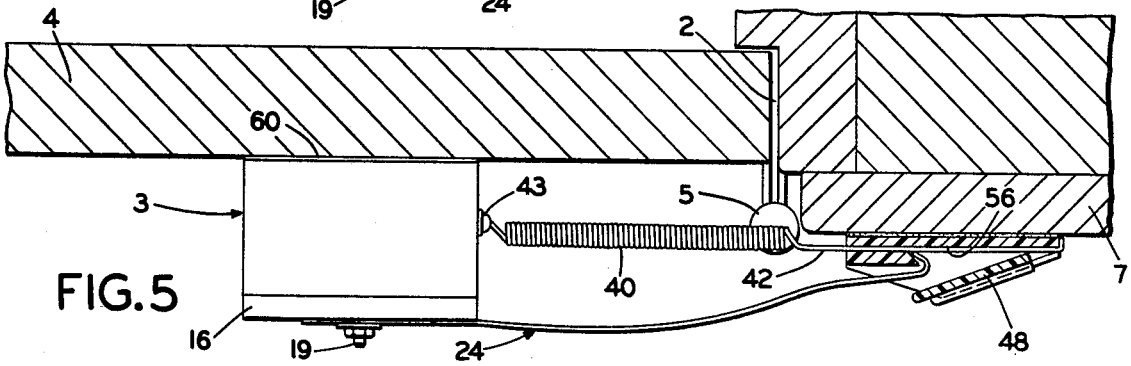
FIG. 5 is a view similar to FIG. 4 showing the arming lever being maintained in alarm-actuating position even after the opened door of FIG. 4 is closed.

In accordance with another feature of the invention, the alarm is maintained actuated even should door 4 be immediately closed after the alarm is sounded moving lever end 26 and door 4 from the position of FIG. 4 to that of FIG. 5. Hook end 26 of lever 24 will engage the undercut of shelf 52 formed by edge 54 and maintain contact with spring end 42 even after the door is closed. The alarm will continue to sound until lever 24 is manually removed from engagement with spring end 42. During the day or at times when protection of the doorway is not desired, lever 24 is pivoted to its disarmed position, shown in dot-dash lines in FIG. 2.

In accordance with another feature of the invention, door alarm 1 enables the user to automatically arm the alarm upon leaving the protected dwelling. The user opens door 4 a sufficient amount to enable him to exit therethrough and places hooked end 26 of lever 24 in the guide channel 63 formed between spaced ribs 49 of actuator block top wall 48, as shown in FIG. 11. Upon closing door 4, hook end 26 will slide upwardly along wall 48 within guide channel 63 and when the door is completely closed, will drop off of outer edge 62 of wall 48 and onto top surface 53 of shelf 52, as shown in FIG. 12. This position arms the alarm for the subsequent contact of hooked end 26 with spring end 42 upon the subsequent opening of door 4 in the manner described above. The biasing effect imparted to lever end 26 ensures that end 26 will move inwardly and downwardly from top wall edge 62 and into contact with shelf 52 for subsequent inward movement and engagement with spring end 42 when the door is open.

The alarm will automatically sound when the door is next opened, either by an intruder or user of the alarm. However, the user, knowing the location of the alarm and its means of operation, can quickly disengage lever end 26 from within actuator block 6, deenergizing the alarm. Most intruders will be very reluctant to enter completely through the door if an alarm is sounding, especially if they are not sure of the alarm's location.

Top wall 48 has a relatively tight sliding frictional engagement within grooves 47 of actuator block side walls 45-46 to permit adjustment between wall edge 62 and shelf 52 to ensure that hook end 26 will properly position itself on shelf 52 upon moving beyond edge 62. Final adjustment is made for both the travel distance of lever end 26 and the biasing thereof by bowing the intermediate portion 64 of lever 24, as shown in FIGS. 3–5.

Door alarm 1 thus provides a relatively simple and inexpensive construction, preferably formed of a molded plastic, electrical insulating material which can be readily mounted for permanent installation on a door and frame by a pressure-sensitive adhesive, and which can be transported easily and used while traveling without marring the door and frame surfaces when removing housing-alarm assembly 3 and actuator 6 therefrom. The improved alarm also is relatively small, compact, and lightweight, facilitating its storage and carrying in an individual's luggage during travel.

Improved door alarm 1 provides the desirable features of maintaining the alarm energized once actuated by an intruder even though the intruder immediately closes the door, in which the alarm is energized immediately upon a very slight opening of the door preventing an intruder gaining access to the alarm and disarming the same before it sounds, and in which the alarm can be automatically armed by the user when leaving the protected doorway by simple, inexpensive and easily maintained mechanical actuating means. Likewise, should lever 24, spring 40 or other components of the improved alarm become damaged, the components can be replaced easily by readily available purchased items.

It is easily understood that actuator block 6 can be mounted on the door with housing 11 being mounted on the frame horizontally adjacent thereto without affecting the concept of the invention.

Accordingly, the construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding, but now necessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the door alarm is constructed and used, the characteristics of the construction, and the advantageous, new and useful results obtained; the new and useful structures, devices, elements, arrangements, parts, and combinations, are set forth in the appended claims.

I claim:

1. A door alarm including:

(a) a housing adapted to be mounted on a door adjacent the hinged edge of said door;

(b) audible alarm means contained within the housing;

(c) an actuator block adapted to be mounted on the door frame adjacent the alarm means housing;

(d) conductor means operatively connected to the alarm means and extending between the alarm means and actuator block;

(e) lever means mounted on the housing and connected to the alarm means and cooperatively engageable with the actuator block and conductor means, with said lever means being movable upon opening of the door to contact the conductor means at the actuator block and actuate the alarm means; and (f) means provided on the actuator block to maintain contact between the lever means and conductor means once the alarm means is actuated to keep the alarm means actuated upon closing movement of the door.

2. The alarm construction defined in claim 1 in which the conductor means is a metallic coil spring.

3. The alarm construction defined in claim 2 in which the coil spring terminates in an elongated end which extends along a portion of the actuator block and is engaged by the lever means to actuate the alarm means.

4. The alarm construction defined in claim 3 in which the actuator block has front shelf means formed of an electrical insulating material; in which an opening is formed beneath the shelf means; and in which the elongated spring end extends through the opening and beyond the shelf means.

5. The alarm construction defined in claim 4 in which the shelf means is formed with an undercut; in which the lever means has a hook-shaped outer end; and in which the lever means outer end projects into the undercut of the shelf means to maintain contact with the spring end to keep the alarm means actuated if the door is closed after said alarm means is actuated.

6. The alarm construction defined in claim 1 in which the actuator block and housing each have a pressure-sensitive adhesive on the bottom thereof for mounting said actuator block and housing on the door frame and door, respectively.

7. The alarm constuction defined in claim 1 in which the actuator block includes a bottom wall and a pair of spaced side walls; in which a shelf is formed on a front portion of the bottom wall with the lever means being operatively engaged with said shelf when in an armed position; in which the conductor means extends along the bottom wall of the actuator block adjacent the shelf; and in which the lever means disengages the shelf and engages the conductor means when the door is opened to actuate the alarm means.

8. The alarm construction defined in claim 7 in which the actuator block has a top wall with a front edge that is spaced outwardly from the shelf; in which the lever means has an extended end which is adapted to engage the conductor means to actuate the alarm means; in which the extended end of the lever means is engageable with the top wall of the actuator block; and in which said extended end moves past the top wall front edge and engages the shelf to automatically arm the door alarm.

9. The alarm construction defined in claim 8 in which the side walls of the actuator block are formed with rearwardly extending grooves; and in which the top wall is slidably adjustably mounted in the side wall grooves.

10. The alarm construction defined in claim 8 in which a pair of spaced ribs is formed on the top wall of the actuator block and define a guide channel therebetween; and in which the extended end of the lever means is located in the guide channel when engaged with the top wall.

11. The alarm construction defined in claim 8 in which the lever means is formed of spring steel and is formed to bias the extended end thereof toward the actuator block.

12. The alarm construction defined in claim 1 in which the alarm means includes a battery and a sound-producing buzzer operable by said battery.

13. The alarm construction defined in claim 1 in which the lever means is pivotally mounted on the housing and movable between an armed position and a disarmed position.

14. Door alarm construction including:

(a) a housing adapted to be mounted on a door adjacent the hinged edge of the door;

(b) battery-operated alarm means located within the housing;

(c) a metallic lever pivotally mounted on the housing and operatively connected to the alarm means, said lever means being movable between armed and disarmed positions;

(d) an actuator block adapted to be mounted on a door frame adjacent the housing;

(e) a metallic coil spring connected at one end to the housing and alarm means and at other end to the actuator block; and (f) the lever having an extended end engageable with the actuator block when in armed position, whereupon opening movement of the door moves said extended end into engagement with the other end of the coil spring to actuate the alarm means.

15. The alarm construction defined in claim 14 in which the actuator block includes first means cooperating with the extended lever end to maintain the alarm means actuated when the door is reclosed.

16. The alarm construction defined in claim 14 in which the actuator block includes second means cooperating with the extended lever end to automatically arm the lever when the door is closed.

17. The alarm construction defined in claim 14 in which the lever is formed of spring steel and biases the extended end of the lever toward the actuator block.

* * * * *

UNITED STATES PATENT AND TRADEMARK OFFICE

CERTIFICATE OF CORRECTION

PATENT NO. : 4,222,042

DATED : September 9, 1980

INVENTOR(S) : Richard E. Cantley

It is certified that error appears in the above–identified patent and that said Letters Patent are hereby corrected as shown below:

Title, change "DOOR ALARM" to--DOOR ALARM WITH SPRING-LEVER ACTUATOR--;

Abstract, delete lines 1-3 which read "An improved door alarm which is mounted on the inside of a door adjacent the hinged edge thereof sounds an audible alarm when the door is opened.";

Abstract, line 5, add --inside of a-- before "door" and --adjacent the hinged edge thereof-- after "door";

Column 1, line 53, change "user" to --user's--;

Column 3, line 38, change "door" to --door's--;

Column 4, line 10, add --(FIG. 3)-- after "26";

Column 4, line 23, add --(FIG. 4)-- after "6";

Column 4, line 55, add --horizontally adjacent housing 10 (FIG. 2)-- after "7";

Column 4, lines 57 and 58, delete "horizontally adjacent housing 11 (FIG. 2)";

UNITED STATES PATENT AND TRADEMARK OFFICE

CERTIFICATE OF CORRECTION

PATENT NO. : 4,222,042

DATED : September 9, 1980

INVENTOR(S) : Richard E. Cantley

It is certified that error appears in the above-identified patent and that said Letters Patent are hereby corrected as shown below:

Column 4, line 68, delete "hook end 26" and "it", and add --hook end 26-- after "54,";

Column 7, line 44, add --when the door is open-- after "block";

Column 7, line 47, add --as the door is closed-- after "alarm";

Column 7, line 50, delete "rearwardly extending";

Column 8, line 40, delete "first"; and

Column 8, line 44, delete "second".

Signed and Sealed this

*Twenty-fifth* Day of *November 1980*

[SEAL]

*Attest:*

*Attesting Officer*

SIDNEY A. DIAMOND

*Commissioner of Patents and Trademarks*